US010088239B2

(12) United States Patent
Veilleux, Jr. et al.

(10) Patent No.: US 10,088,239 B2
(45) Date of Patent: Oct. 2, 2018

(54) HEAT EXCHANGER WITH IMPROVED FLOW AT MITERED CORNERS

(71) Applicant: Hamilton Sundstrand Corporation, Charlotte, NC (US)

(72) Inventors: Leo J. Veilleux, Jr., Wethersfield, CT (US); Lubomir A. Ribarov, West Hartford, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 376 days.

(21) Appl. No.: 14/723,612

(22) Filed: May 28, 2015

(65) Prior Publication Data

US 2016/0348980 A1 Dec. 1, 2016

(51) Int. Cl.

| | |
|---|---|
| ***F28F 3/02*** | (2006.01) |
| ***F28D 1/03*** | (2006.01) |
| ***F28F 3/04*** | (2006.01) |
| *F28D 21/00* | (2006.01) |

(52) U.S. Cl.
CPC ..... *F28D 1/035* (2013.01); *F28F 3/046* (2013.01); *F28D 2021/0021* (2013.01)

(58) Field of Classification Search
CPC ..... F28D 9/0068
USPC ..... 165/166, 167
See application file for complete search history.

(56) References Cited

U.S. PATENT DOCUMENTS 2,439,208 A * 4/1948 Gloyer ..... F28D 9/0068 165/140
3,289,757 A 12/1966 Rutledge
3,327,776 A * 6/1967 Butt ..... F28D 9/0068 165/170
3,380,517 A * 4/1968 Butt ..... A01B 11/00 165/139
3,669,186 A * 6/1972 Schauls ..... F28F 9/02 165/166
3,992,168 A * 11/1976 Toyama et al. ..... B01D 5/0015 165/166
4,282,927 A 8/1981 Simmons
(Continued)

FOREIGN PATENT DOCUMENTS

CN 103256839 A 8/2013
EP 0074740 A2 3/1983
(Continued)

OTHER PUBLICATIONS

Great Britain Search Report for United Kingdom Patent Application No. 1609003.7 completed Sep. 16, 2016.

*Primary Examiner* — Allen Flanigan
(74) *Attorney, Agent, or Firm* — Carlson, Gaskey & Olds, P.C.

(57) ABSTRACT

A heat exchanger has a first flow path communicating fluid into a turning flow path at a first mitered interface. The turning flow path has a second mitered interface for communicating fluid from the turning flow path into a return flow path. The first flow path extends in a nominal direction toward the turning flow path. First flow passages within the first flow path and return flow passages in the return flow path are provided by walls having alternating sections which extend in opposed angular directions relative to nominal directions. Sizes of a portion of passages at the interfaces are different such that some passages are larger than other openings into other passages.

9 Claims, 3 Drawing Sheets

(56) References Cited

U.S. PATENT DOCUMENTS

| | | | | | |
|---|---|---|---|---|---|
| 4,496,382 | A * | 1/1985 | Geist et al. | F25J 3/0209 62/623 |
| 4,623,019 | A | 11/1986 | Wiard | |
| 4,862,952 | A * | 9/1989 | Tarasewich et al. | F28D 9/0068 165/159 |
| 5,035,284 | A | 7/1991 | Oya et al. | |
| 5,611,214 | A | 3/1997 | Wegeng et al. | |
| 5,915,469 | A * | 6/1999 | Abramzon et al. | B64D 13/00 165/134.1 |
| 6,460,613 | B2 * | 10/2002 | Nash et al. | F28D 9/0043 165/146 |
| 6,736,201 | B2 | 5/2004 | Watton et al. | |
| 7,235,218 | B2 * | 6/2007 | Bowe | B01J 19/249 422/211 |
| 2003/0079870 | A1 | 5/2003 | Watton et al. | |
| 2016/0084205 | A1 | 3/2016 | Maucher et al. | |

FOREIGN PATENT DOCUMENTS

| | | | | |
|---|---|---|---|---|
| EP | 2754486 | A1 | 7/2014 | |
| GB | 130104 | A | 7/1919 | |
| GB | 2132748 | A * | 7/1984 | F28D 9/0068 |
| GB | 2328275 | A | 2/1999 | |
| NZ | 201673 | A | 7/1986 | |
| WO | 9721064 | | 6/1997 | |
| WO | 9737187 | | 10/1997 | |
| WO | 9853263 | | 11/1998 | |
| WO | 9855812 | | 12/1998 | |

* cited by examiner

HEAT EXCHANGER WITH IMPROVED FLOW AT MITERED CORNERS

BACKGROUND OF THE INVENTION

This application relates to a heat exchanger having a first flow path leading into a mitered interface with a turning flow path, which then communicates to a return flow path, also having a mitered interface.

One type of heat exchanger, known as a "herringbone" heat exchanger, has a plurality of flow passages defined between alternating sidewalls. The sidewalls have a first portion extending in one direction across a nominal flow direction, and leading into a second wall portion extending in an opposed direction. The overall effect is that the flow paths resemble herringbone designs.

Herringbone heat exchangers are high performance devices. The design is optimized for a conventional stack up.

The resulting high density fin count that is provided allows high heat transfer, thus, increasing the effectiveness of the heat exchanger. Such heat exchangers are particularly useful in aircraft thermal management systems.

The heat exchangers may exchange heat between fluids at any fluid state, such as gas, liquid, or vapor.

However, there are some challenges with such heat exchangers.

SUMMARY OF THE INVENTION

A heat exchanger has a first flow path for communicating fluid into a turning flow path at a first mitered interface. The turning flow path has a second mitered interface for communicating fluid from the turning flow path into a return flow path. The first flow path extends in a nominal direction toward the turning flow path. The return flow path extends in a nominal direction away from the turning flow path. First flow passages within the first flow path and return flow passages in the return flow path are provided by walls having alternating sections which extend in opposed angular directions relative to the nominal directions. Turning flow passages extend through the turning flow path from the first and second mitered interfaces. Sizes of a portion of the first flow passages and the turning flow passages at the first interface are different such that openings into one of the first and turning flow passages are larger than openings into the other of the first and turning flow passages. Sizes of a portion of the return flow passages and the turning flow passage at the second interface are different such that the openings into one of the return and turning flow passages are larger than openings into the other of the second and turning flow passages. A source of a fluid is communicated to the first flow path and a downstream use for the fluid communicates with the return flow path.

These and other features may be best understood from the following drawings and specification.

DETAILED DESCRIPTION

Figure 1:
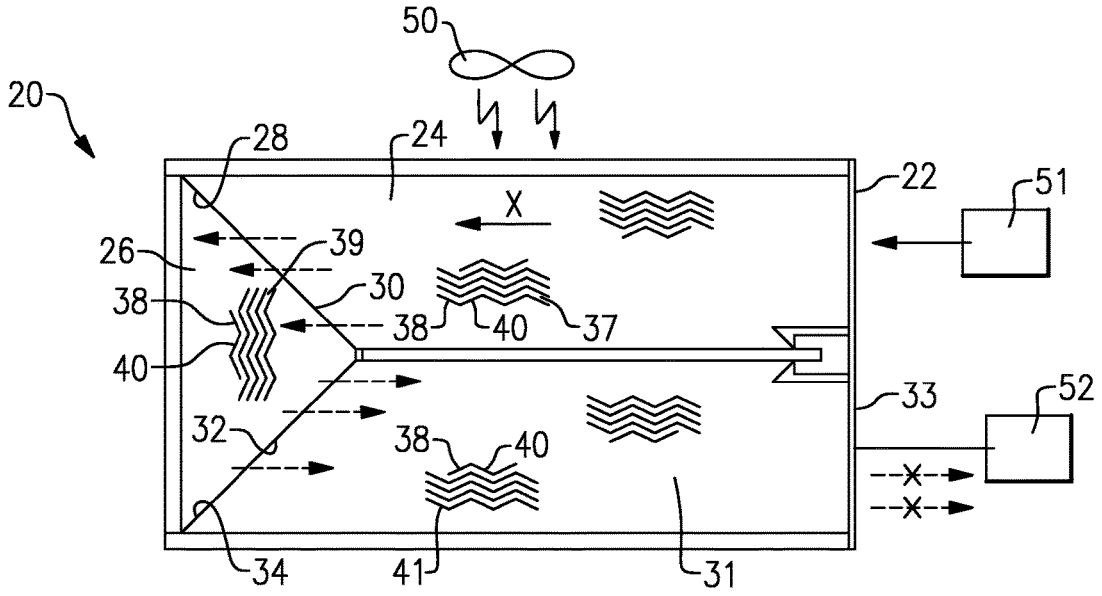
FIG.1 Prior Art
FIG. 1 shows a prior art heat exchanger.

A heat exchanger 20 is illustrated in FIG. 1 having an inlet 22 leading into a first flow path 24. The first flow path communicates with a turning flow path 26. A mitered interface 28/30 is defined between the flow paths 24 and 26. The turning flow path 26 leads into a return flow path 31, leading to an outlet 33. There is a mitered interface 32/34 between the turning flow path 26 and the return flow path 31.

Flow passages in the paths 24, 26, and 31 are provided as herringbone shaped passages 37 and 39. The herringbone shape is defined by alternating wall sections 38 and 40. Wall section 38 extends in one angular direction relative to a nominal flow direction X while the wall portion 40 extends in an opposed direction relative to a nominal flow direction X. The result is a herringbone shaped flow passage.

A fan 50 is shown for moving air across the heat exchanger to cool the fluid. It should be understood that this is merely one example and that other heat exchanger applications may be utilized. A source of fluid 51 is shown for sending fluid into the first flow path 24 and a use for the fluid 52 is shown communicating with the return flow path 31.

Figure 2:
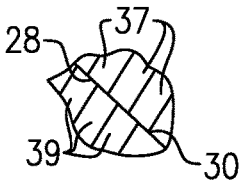
FIG.2 Prior Art
FIG. 2 shows a problem with the prior art heat exchanger.

A challenge with such heat exchangers is illustrated in FIG. 2. As shown, flow passages 37 may not be aligned with flow passages 39 at the interface 28/30. The same is true at the interface 32/34.

The openings into the passages (and the passages themselves) may be very small. As an example, the hydraulic diameter of the flow passages may be less than one millimeter.

When the flow passages 37 and 39 do not match up at the mitered interface 28/30, there is an excessive pressure drop and inefficient fluid distribution. Hence, the heat exchanger performance deteriorates. The same challenge arises at the interface 32/34.

Figure 3A:
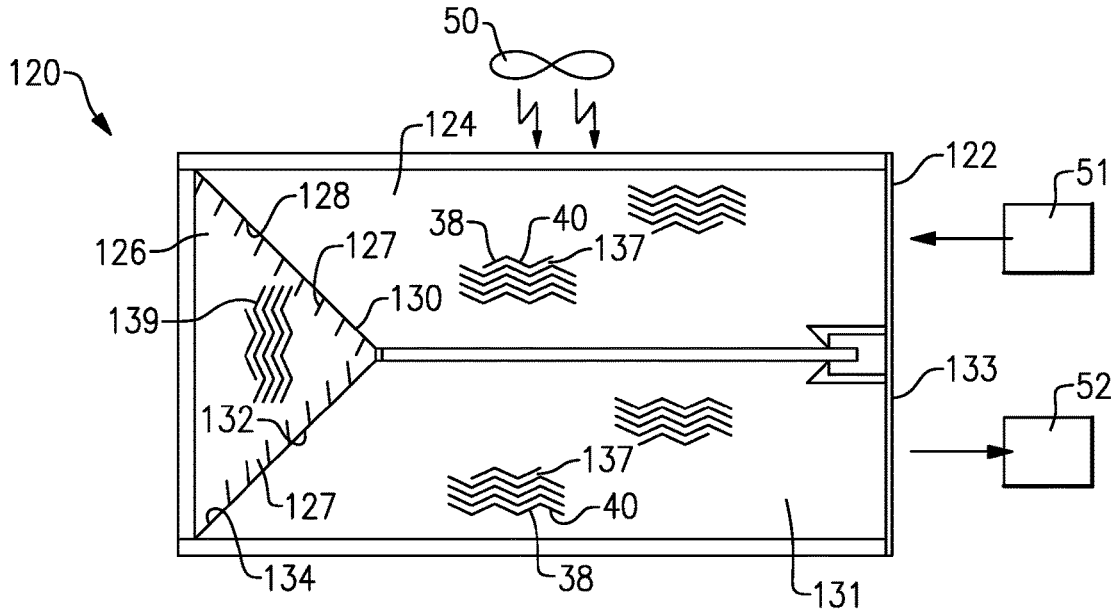
FIG. 3A shows a first embodiment.
Figure 3B:
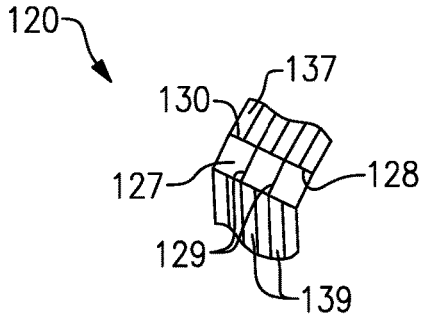
FIG. 3B shows a detail of the first embodiment.

FIG. 3A shows a heat exchanger 120 having an inlet 122 leading into a first flow path 124. First flow path 124 communicates into a turning flow path 126 at a mitered interface 128/130. The turning flow path 126 has a mitered interface 132/134 with return flow path 131. As shown, the herringbone walls 38 and 40 define herringbone-shaped flow passages 137 in the flow paths 124 and 131. Similarly, the herringbone walls 38 and 34 define the flow path 139 in the turning flow path 126. However, as seen in FIGS. 3A and 3B, a transition segment defining transition flow passages 127 of enlarged width is provided at the interfaces 130 and 132. These transition flow passages are defined by facing, spaced apart walls 129 that are spaced apart a different (greater) amount compared to the spacing of the walls defining passages 137 and 139 as seen in FIG. 3B.

FIG. 3B shows a detail. The flow passages 137 from the first flow path 124 communicate into the transition flow passages 127 of the transition segment at the interface 130. A plurality (here, two, but other numbers may be utilized) of flow passages 139 are connected hydraulically to an individual transition flow passage.

Now, should there be some misalignment, there is less likelihood that there would be flow blockage between the passages 137 and the openings 127, and the pressure drop problems described above are reduced.

Figure 3C:
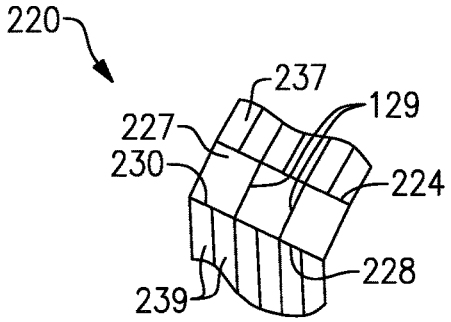
FIG. 3C shows an alternative embodiment.

FIG. 3C shows an embodiment 220 wherein the enlarged openings 227 are within the first flow path 224 and extend to the interface 228. The interface 230 is provided with a plurality of flow passages 239. A plurality of flow passages 237 in the first flow path communicate with the enlarged passages 227. Again, the benefits described above would be achieved.

Figure 4A:
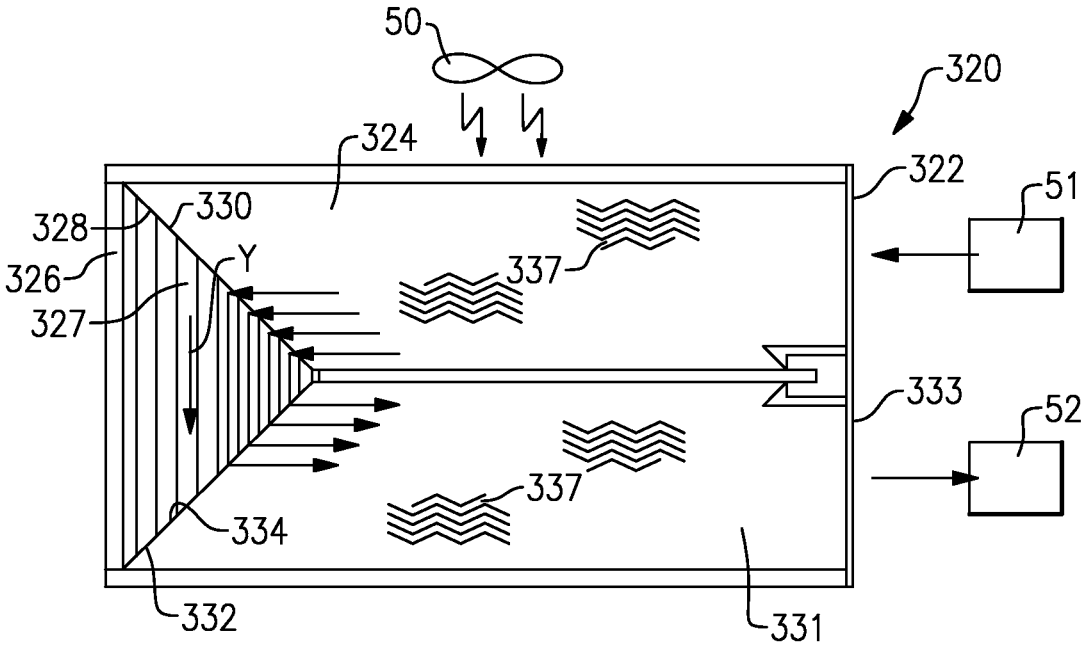
FIG. 4A shows another alternative embodiment.

FIG. 4A shows yet another embodiment 320. Inlet 322 leads into first flow path 324 and to turning path 326. Passages 327 in the turning flow path extend parallel to the nominal flow direction Y within the turning path 326.

Figure 4B:
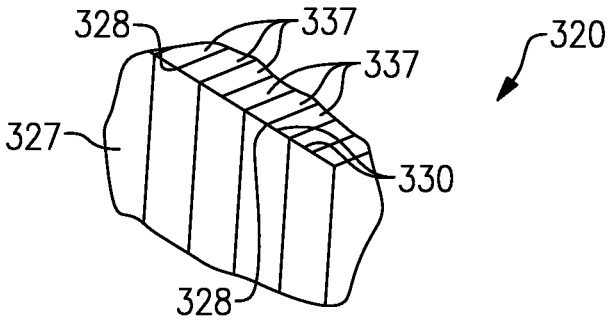
FIG. 4B shows a detail of the FIG. 4A embodiment.

Further, as illustrated in FIG. 4B, at the interface 330, the hydraulic diameter of openings into the passages 327 is larger than the hydraulic diameter of the passages 337. As illustrated, there are approximately two flow passages 337 combined to equal the size of the opening into a passage 327. Again, other dimensional relationships can be utilized. However, the size of the openings in the passages 327 is larger than the size of the openings from the passages 337. Again, the flow blockage, as described above, will be addressed by this arrangement.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A heat exchanger comprising:

a first flow path for communicating fluid into a turning flow path at a first mitered interface, said turning path having a second mitered interface for communicating fluid from said turning flow path into a return flow path;

the return flow path extends in a nominal direction away from the turning flow path, said first flow path extends in a first nominal direction toward said turning flow path, first flow passages within said first flow path and return flow passages in said return flow path are provided by spaced apart walls having alternating sections which extend in opposed angular directions relative to the nominal directions and define respective first passages width and return passage widths;

turning flow passages also provided by walls having facing portions spaced apart to define turbine passage widths; said turning flow passages extend through said turning flow path from said first to said second mitered interface, and a transition segment defined at each of the first and second mitered interfaces comprising transition passages defined by spaced apart walls defining transition passage widths;

wherein the widths of said transition flow passages at the first mitered interface are larger than the first passage widths and the turning passage widths at said first mitered interface, and/or the widths of the transition flow passages at the second mitered interface are larger than the turning passage widths and the return passage widths at said second mitered interface.

2. The heat exchanger as set forth in claim 1, wherein said turning flow passages are also formed by wall sections extending in opposed directions relative to a nominal flow direction through said turning flow path.

3. The heat exchanger as set forth in claim 1, wherein said turning flow passages extend parallel to a nominal flow direction through said turning flow path.

4. A heat exchanger comprising:

a source of fluid communicating into a first flow path communicating fluid into a turning flow path at a first mitered interface, said turning path having a second mitered interface for communicating fluid from said turning flow path into a return flow path and communicating to a use for the fluid;

the return flow path extends in a nominal direction away from the turning flow path, said first flow path extends in a first nominal direction toward said turning flow path, first flow passages within said first flow path and return flow passages in said return flow path are provided by spaced apart walls having alternating sections which extend in opposed angular directions relative to the nominal directions such that the first flow passages and the return flow passages are herringbone-shaped;

said spaced apart walls defining respective first passage widths and return passage widths;

turning flow passages also provided by walls having facing portions spaced apart to define turning passage widths; said turning flow passages extend through said turning flow path from said first to said second mitered interface, and a transition segment defined at each of the first and second mitered interfaces comprising transition passages defined by spaced apart walls defining transition passage widths;

wherein the widths of said transition flow passages at the first mitered interface are larger than the first passage widths and the turning passage width at said first mitered interface, and/or the widths of the transition flow passages at the second mitered interface are larger than the turning passage width and the return passage widths at said second mitered interface.

5. The heat exchanger as set forth in claim 4, wherein said turning flow passages extend parallel to a nominal flow direction through said turning flow path.

6. The heat exchanger as set forth in claim 5, wherein said turning flow passages are also formed by wall sections extending in opposed directions relative to a nominal flow direction through said turning flow path.

7. The heat exchanger as set forth in claim 4, wherein said turning flow passages are also formed by wall sections extending in opposed directions relative to a nominal flow direction through said turning flow path.

8. The heat exchanger as set forth in claim 1, wherein said transition segment is part of said turning passages.

9. The heat exchanger as set forth in claim 1, wherein said transition segment is part of at least one of said first and second flow passages.

* * * * *